United States Patent [19]

Warren

[11] 4,071,989

[45] Feb. 7, 1978

[54] SOUND INSULATIVE MASONRY BLOCK

[75] Inventor: Millard R. Warren, Knoxville, Tenn.

[73] Assignee: Warren Insulated Bloc, Inc., Knoxville, Tenn.

[21] Appl. No.: 650,029

[22] Filed: Jan. 19, 1976

[51] Int. Cl.[2] ..... E04B 1/82

[52] U.S. Cl. ..... 52/145; 52/407; 181/285

[58] Field of Search ..... 52/145, 405, 407, 144, 52/606, 607; 181/33.6

[56] References Cited

U.S. PATENT DOCUMENTS

| | | | |
|---|---|---|---|
| 2,944,622 | 7/1960 | Dobbins | 52/145 X |
| 3,001,602 | 9/1961 | Taylor | 52/145 X |
| 3,275,101 | 9/1966 | Morrissey et al. | 181/33.6 |
| 3,837,426 | 9/1974 | Kleinschmidt | 52/145 X |
| 3,846,949 | 11/1974 | Okawa | 52/145 X |

FOREIGN PATENT DOCUMENTS

| | | | |
|---|---|---|---|
| 1,066,958 | 6/1957 | France | 52/405 |
| 2,116,116 | 4/1971 | Germany | 52/145 |

*Primary Examiner*—Ernest R. Purser
*Assistant Examiner*—Carl D. Friedman
*Attorney, Agent, or Firm*—Burns, Doane, Swecker & Mathis

[57] ABSTRACT

A masonry block includes pairs of opposed side walls and opposed web walls forming a cavity therebetween. One of the side walls is apertured to conduct sound waves into the cavity. A panel formed of acoustically insulative material is disposed in the cavity and is spaced from the side walls to form front and rear sound damping chambers therebetween. Sound waves passing through the apertured side wall enter the front damping chamber and are subjected to a damping action within the block. Various sizes, shapes, and patterns of openings in the apertured side wall can provide varying sound damping effects. The panel may be inclined at an acute angle relative to the apertured side wall. The block cavity may be divided into cavity portions of different volume to provide for effective sound damping of high and low frequency sound waves.

4 Claims, 13 Drawing Figures

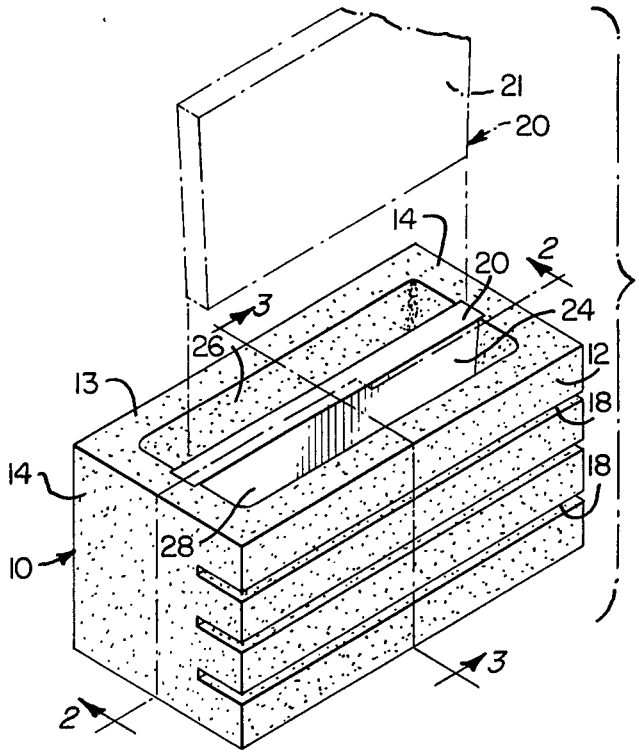
FIG. 1.
FIG. 2.
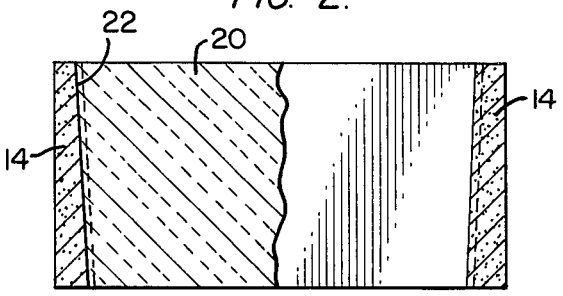
FIG. 3.
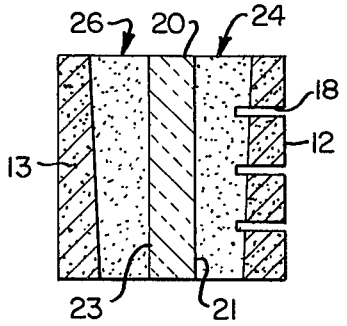
FIG. 4.
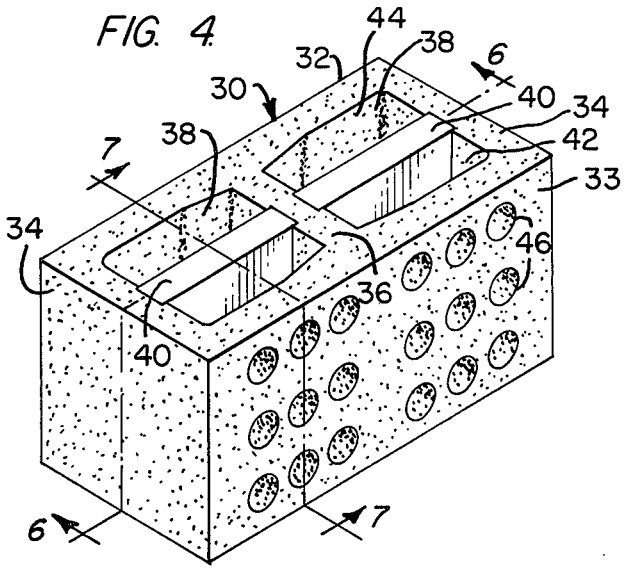
FIG. 5.
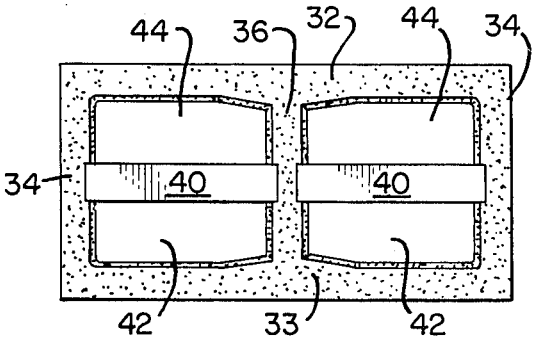

SOUND INSULATIVE MASONRY BLOCK

BACKGROUND AND OBJECTS OF THE INVENTION

This invention relates to sound control building material and, more particularly, to a sound-damping concrete building block.

Techniques for damping sound within buildings have included the practice of installing sound damping materials such as asbestos onto the inner wall surface. The installation of such materials is both costly and time consuming and diminishes the interior dimensions of the building.

Proposals have been made in U.S. Pat. Nos. 1,660,745; 2,007,130; and 2,933,146 for incorporating sound absorbing features within building blocks. These proposals are each characterized by essentially filling the inner cavity or cavities of a building block with insulative material, and providing openings on that side wall of the block which is intended to face the internal space of the building. While such proposals are advantageous in diminishing the level of noise within the building, substantial room for improvement remains.

It is therefore, an object of the present invention to provide a novel masonry building block which effectively dampens sound.

It is another object of the present invention to provide a novel masonry block which effectively captures and dampens sound waves of different frequencies.

SUMMARY OF THE INVENTION

These objects are achieved by the present invention which involves a masonry block having pairs of opposed side walls and opposed web walls forming a cavity therebetween. One of the side walls is apertured to conduct sound waves into the cavity. A panel formed of acoustically insulative material is disposed within the cavity. The panel is spaced from the side walls to form front and rear sound damping chambers therebetween on opposite sides of the panel. Sound waves passing through the apertured side walls thereby enter the cavity for being effectively diminished in intensity through interaction with the insulative panel and the front and rear sound damping chambers. The openings in the block can be of a selected size, shape and pattern, depending upon the amount of sound damping desired. An intermediate web wall can be provided to divide the cavity into cavity portions of different volume so that the larger cavity portion can effectively dampen lower frequency sound waves and the lower volume cavity portion can dampen higher frequency sound waves. The panel can extend parallel to, or at an angle, relative to the apertured side wall.

THE DRAWINGS

Preferred forms of the invention are depicted in the accompanying drawings in which:

FIG. 1 is an isometric view of one form of sound damping block according to the present invention;

FIG. 2 is a longitudinal sectional view taken along line 2—2 of FIG. 1;

FIG. 3 is a cross-sectional view taken along line 3—3 of FIG. 1;

FIG. 4 is an isometric view of another form of masonry block in accordance with the present invention;

FIG. 5 is an overhead plan view of the block of FIG. 5;

DETAILED DESCRIPTION OF THE PREFERRED EMBODIMENTS

Figure 6:
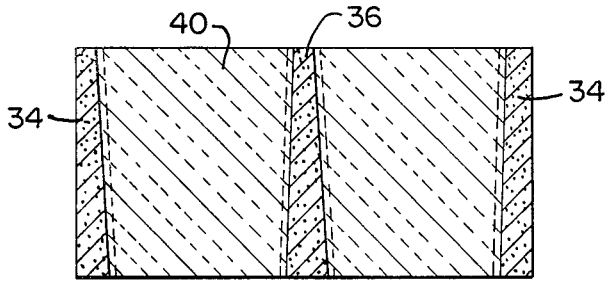
FIG. 6 is a longitudinal sectional view taken along line 6—6 of FIG. 4.
Figure 7:
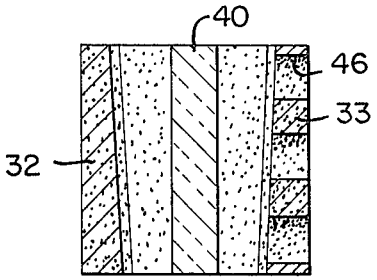
FIG. 7 is a cross-sectional view taken along line 7—7 of FIG. 4.

One preferred form of masonry building block 10 is accordance with the present invention in disclosed in FIGS. 1-3. The block is formed of concrete and includes front and rear side walls 12, 13 interconnected at their ends by a pair of web walls 14. The side and web walls define a cavity 16 therebetween. Such a block is conventional and can be fabricated by well known molding techniques.

A plurality of openings are formed in the front side wall 12 of the block intended to face the interior of a building formed of such blocks. The openings are in the form of vertically spaced, horizontal slots 18 which projects completely through the side wall 13 and communicate with the cavity 16. Three such openings are depicted in FIG. 1, although it will be realized that the number and size of such openings can vary. Formation of the slots 18 can be accomplished during molding of the block, or by a suitable cutting procedure subsequent to the molding operation.

Situated within the cavity 16 is a panel or plate 20 of acoustically insulative material formed, for example, of fiberglass board or other suitable types of sound damping material.

The panel 20 is preferably installed into downwardly converging channels 22 formed in the web walls 14. In so doing, the panel 20 is compressed and forms a firm, frictional fit within the block 10. Insertion of the panels can be conveniently performed at the factory or work site as desired.

The acoustical panel 20 has front and rear surfaces 21, 23 that are spaced from side walls 12, 13 to form front and rear damping chambers 24, 26. As a result, sound waves passing through the slots 18 will enter the front damping chamber 24. Portions of these sound waves will enter the panel 20 and other portions will reflect forwardly therefrom. Through the conversion of energy into heat, mainly through friction, the energy of these sound waves will be significantly diminished. Of course those sound waves entering the panel will be subjected to a greater degree of energy damping.

The reflected sound waves will be contained within the chamber 24 and will be further weakened by subsequent interaction with the walls defining the chamber 24, including, possibly, further impingement against the panel 20. Interaction with out-of-phase waves within the chamber 24 is also possible to dampen the reflected sound waves.

Sound wave portions which pass through the panel 20, most likely at significantly reduced energy, will be subjected to further damping effects within the rear chamber 26 similar to that performed on the reflected waves within the front chamber 24.

That is, such sound waves will interact with the wall portions forming the rear chamber 26 and may eventually re-encounter the panel20, and will thereby be subjected to a reduction in the level of energy intensity. Sound waves within the rear chamber 26 may also encounter out-of-phase sound waves in a manner reducing the energy level of both such waves.

Consequently, it will be apparent that sound waves entering the cavity 16 are faced with a highly effective arrangement of damping chambers and insulative paneling for diminishing sound wave intensity.

Preferably, the panel 20 is disposed about midway between the side walls 12, 13, with the surfaces 21, 23 each being spaced from the respective side walls by a distance greater than one quarter of the overall spacing between the side walls.

These sound-damping principles can be employed in blocks of different size and shape and with openings of different size and shape. For example, masonry block 30, depicted in FIGS. 4–7 has two side walls 32, 33, two end web walls 34, and an intermediate web wall 36 which divides the inner cavity into a pair of cavity portions 38. Each cavity portion 38 has disposed therein an insulative panel 40, dividing the cavity portions into front and rear damping chambers 42, 44.

The side wall 33 is provided with a plurality of circular openings 46 which communicate with the front chambers 42. These openings 46 conduct sound waves into the chambers 42 to be acted upon in the same manner discussed previously in conjunction with the block 10.

Figure 13:
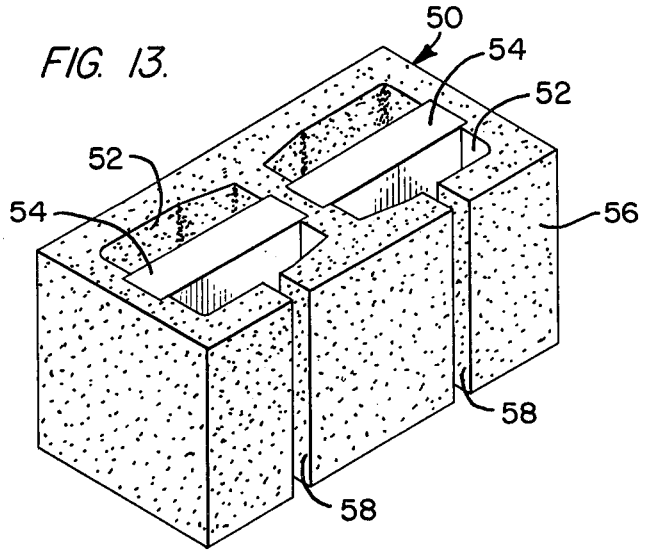
FIG. 13 is an isometric view illustrating still another preferred form of masonry block in accordance with the present invention.

The openings in the blocks 10, 30 can be of a selected size, shape, and pattern, depending on the amount of sound damping desired, and also depending upon what particular range of the audible noise spectrum is desired to be damped. In FIG. 13, for example, a masonry block 50 contains cavity portions 52, and insulative panels 54 within these cavity portions. A side wall 56 contains vertically oriented slots 58 which extend completely therethrough. These slots 58 conduct sound waves into the cavity portions where they are damped in the manner previously described.

Figure 11:
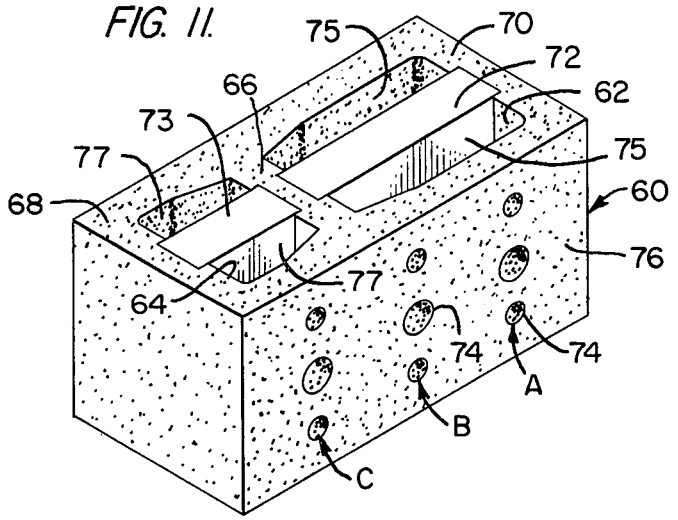
FIG. 11 is an isometric view of another form of masonry block in accordance with the present invention for effectively damping sound waves of different frequency.
Figure 12:
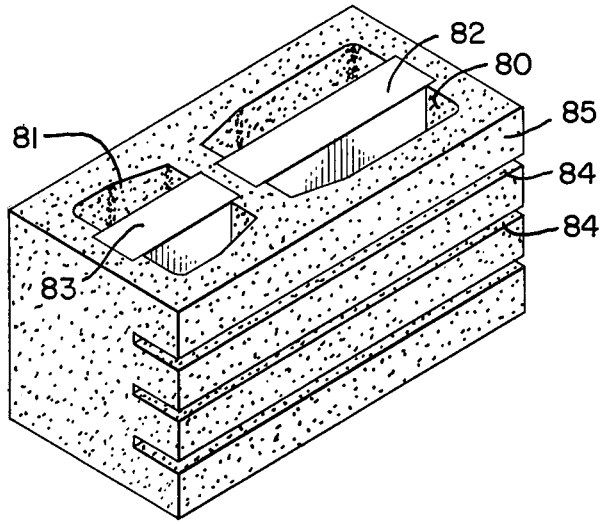
FIG. 12 is an isometric view depicting another preferred form of masonry block for damping sound waves of different frequency according to the present invention.

One block arrangement has been found to be particularly effective in damping sound waves of varying frequency and is depicted in FIGS. 11 and 12. As illustrated in FIG. 11, a block 60 contains cavity portions 62 64 of different volume. This is achieved by placement of an intermediate web wall 66 closer to one of the end web walls 68 than the other end web wall 70. Both cavity portions 62, 64 contain insulative panels 72, 73 of a size corresponding to the size of the respective cavity portions. The panels thus establish front and rear damping chambers 75, 77 within the cavity portions. Openings 74 are provided in a side wall 76 of the block. In FIG. 11, vertical rows A, B, C of three circular openings each are provided, two rows A, B for the larger cavity portion 64, and a single row C for the smaller cavity portion 62. The centermost opening of each row is larger than the remaining two openings.

In FIG. 12, a block similar to FIG. 11 is depicted wherein cavity portions 80, 81 of different volume are provided and which contain appropriately sized panels 82, 83. Openings in the form of vertically spaced slots 84 are provided in side wall 85 to admit sound waves to the interior of the block.

The provision of cavities of different volume within a masonry block as depicted in FIGS. 11 and 12 enables sound waves of different frequencies to be damped. For example, sound waves of relatively low frequency, i.e. large wavelength, are better damped within the larger cavity since the likelihood of contact with an out-of-phase wave is greater. On the other hand, sound waves of high frequency and short wavelength can be accommodated by the smaller volume cavity 62 for being damped by an out-of-phase wave. These effects are heightened by the provision of front and rear damping chambers 75, 77 which aid in damping the intensity of the sound waves as previously discussed.

Once fabricated, the blocks are ready to be employed in erecting a wall structure in the usual fashion. That is, the blocks are laid up and secured by mortar joints. Alternatively, the blocks can be laid up in a dry condition and then secured by the application of a $\frac{1}{8}$ inches layer of fiberglass reinforced resin to the inner and outer surfaces of the wall.

Figure 10:
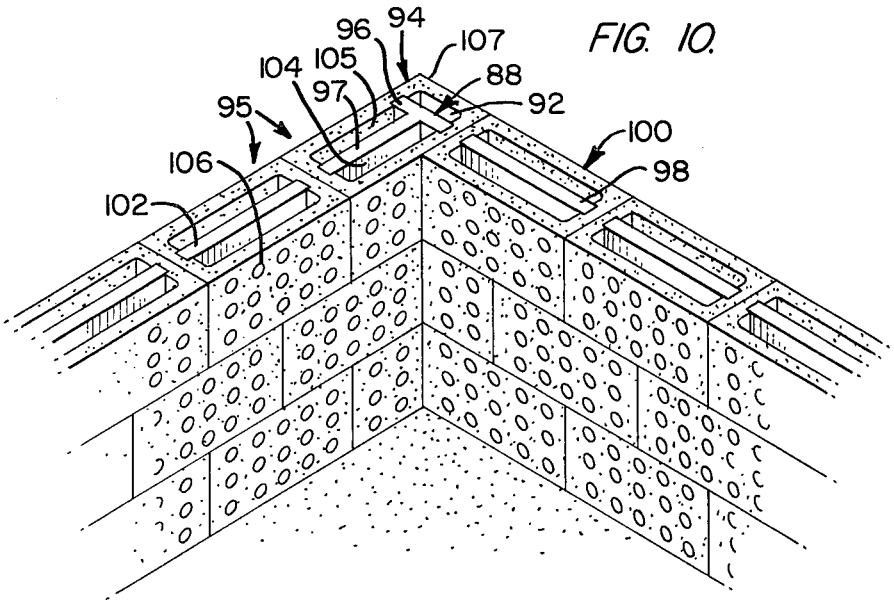
FIG. 10 is an isometric view depicting a partial stacking of blocks to form a wall structure in accordance with the present invention.

In order to establish acoustical insulation at the corners of the building, special panel arrangements may be provided. In FIG. 10, for example, a T-shaped panel arrangement 88 is mounted within a cavity 92 of a block 94, the block 94 forming part of a wall section 95. The panel arrangement 88 includes a head panel 96 and a tail panel 97. The head panel 96 is aligned with the panels 98 in the blocks of an adjacent building wall section 100. The tail panel 97 is aligned with the planar panels 102 of the same building wall section 95. As a result, front and rear sound damping chambers 104, 105 are formed. The front chamber 104 communicates with the building interior via openings 106 in the inner block side wall. The chambers 104, 105 are insulated from the end wall 107 of the block by the head panel 96.

Figure 8:
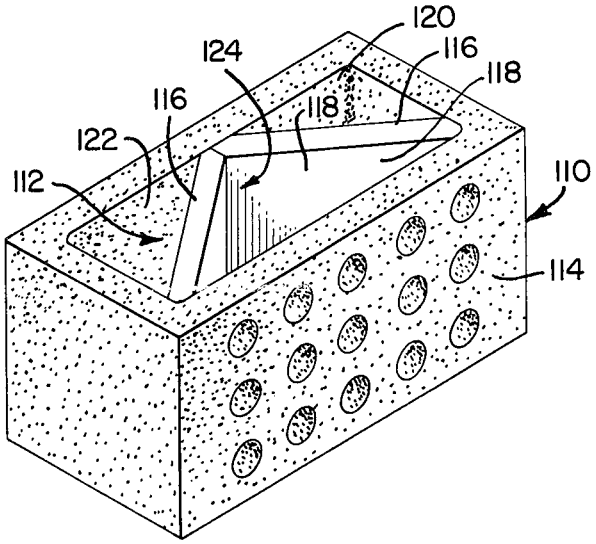
FIG. 8 is an isometric view of another preferred masonry block according to the present invention.
Figure 9:
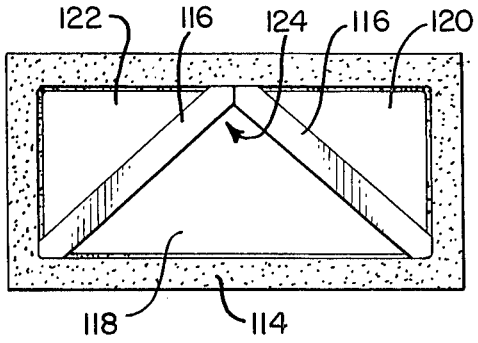
FIG. 9 is a plan view of the block depicted in FIG. 8.

Another desirable form of acoustically insulative block 110 according to the invention is depicted in FIGS. 8–9. The block 110 forms a cavity 112 and includes an apertured side wall 114. Disposed within the cavity is a V-shaped panel arrangement comprised of a pair of panels 116. These panels each extend at an acute angle relative to the side wall 114 so as to form a front sound damping chamber 118. The arrangement is such that the apex 124 of the V-shaped panel and rear damping chambers 120, 122 arrangement faces the apertured side wall 114. Sound waves entering the chamber 118 through the side wall 114 can enter either of the panels 116 or reflect therefrom. Reflected waves will likely be directed toward the other panel 116. As a result, the sound damping effects are maximized. Further noise reduction can be achieved within the rear chambers 120, 122. The block 110 can be utilized as the primary block in the construction of a building and/or can be effectively utilized at corners of the building, since the chamber 118 is isolated from the web walls of the block 110.

Samples of concrete block fabricated of a configuration similar to that disclosed in connection with FIG. 1 have been tested for acoustical damping characteristics. In the absence of a sound damping insert panel 20, the test results were as follows:

| Sound Frequency (Hz) | 125 | 250 | 500 | 1000 | 2000 | 4000 | NCR* |
|---|---|---|---|---|---|---|---|
| Absorption Coefficients | .08 | .41 | .44 | .32 | .5 | .47 | .40 |

*The noise reduction coefficient (NRC) is the average of the absorption coefficients at 250, 500, 1000 and 2000 Hz With the fiberglass panel inserted therein, the same block performed as follows:

| Sound Frequency (Hz) | 125 | 250 | 500 | 1000 | 2000 | 4000 | NRS |
|---|---|---|---|---|---|---|---|
| Absorption Coefficients | .57 | 1.17 | 1.01 | .72 | .58 | .69 | .85 |

It will thus be realized that significant sound damping effects are provided by the invention. These advantages are achieved at relatively minor cost, due to the inexpensive nature of acceptable insulative panel materials. No interior space is lost as occurs when insulative board-like elements are hung against the interior wall surfaces. Installation of the insulative panels is simple, merely requiring a press-fit insertion of the panels into the block cavity. Spacing of the panels from the interior and exterior side walls of the block provides damping chambers on opposite sides of the panel in which effective sound damping can be achieved. An additional damping chamber provided on the other side of the panel further dampens sound waves passing through the panel.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. An acoustic construction block comprising:

pairs of opposed side masonry walls and opposed end web walls of masonry forming a cavity therebetween;

an intermediate web wall of masonry disposed parallel to said end web walls and located closer to one end web than the other to divide said cavity into-side-by-side cavity portions of unequal volume;

each cavity portion being bounded at front and rear sides by one of said side walls, with the dimension of each cavity portion from one side wall to the other being substantially equal;

one of said side walls containing apertures extending completely therethrough and opening into said cavity portions so as to transmit sound waves into said cavity portions;

each end wall including an upright channel in its inner surface and said web wall comprising upright channels on both sides thereof; said channels being situated approximately midway between said side walls; and a first panel of sound insulative material disposed within a larger of said cavity portions, the ends of said first panel being uprightly arranged in said channel of one end wall and one channel of said web wall;

each panel disposed parallel to said side walls and spaced from both of said side walls to form damping chambers on opposite sides of each panel;

said panels being operable to absorb sound waves and conduct sound waves from one damping chamber to the other.

2. A masonry block according to claim 1 wherein said apertured side wall includes circular openings.

3. A masonry block according to claim 1 wherein apertured side wall contains horizontally spaced vertical slots extending from an upper edge of said apertured wall to a lower edge thereof.

4. A masonry block according to claim 1 wherein said apertured side wall contains vertically spaced, horizontally extending slots.

* * * * *